US009728041B2

(12) United States Patent
Anderson et al.

(10) Patent No.: US 9,728,041 B2
(45) Date of Patent: Aug. 8, 2017

(54) WAGERING GAME MACHINE LAYOUT MAPPING

(71) Applicant: WMS Gaming, Inc., Waukegan, IL (US)

(72) Inventors: Peter R. Anderson, Glenview, IL (US); David E. Detlefsen, Northfield, IL (US); Jacob C. Greenberg, Elgin, IL (US); Timothy T. Gronkowski, Chicago, IL (US); Victor V. Lerias, III, Morton Grove, IL (US); Timothy D. Wilson, Oak Park, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 420 days.

(21) Appl. No.: 14/298,712

(22) Filed: Jun. 6, 2014

(65) Prior Publication Data

US 2014/0287823 A1 Sep. 25, 2014

Related U.S. Application Data

(62) Division of application No. 13/508,058, filed as application No. PCT/US2010/055284 on Nov. 3, 2010, now abandoned.

(60) Provisional application No. 61/257,980, filed on Nov. 4, 2009.

(51) Int. Cl.
*G07F 17/32* (2006.01)
*A63F 9/24* (2006.01)

(52) U.S. Cl.
CPC ..... *G07F 17/3258* (2013.01); *G07F 17/32* (2013.01); *G07F 17/3216* (2013.01); *G07F 17/3223* (2013.01); *G07F 17/3232* (2013.01)

(58) Field of Classification Search
CPC ..... G07F 17/3234; G07F 17/3258; G07F 17/3223; G07F 17/3274; G07F 17/3239
See application file for complete search history.

(56) References Cited

U.S. PATENT DOCUMENTS 5,761,647 A * 6/1998 Boushy ..... G06Q 10/06375 463/25
6,843,725 B2 1/2005 Nelson
6,884,170 B2 * 4/2005 Rowe ..... G07F 17/32 463/31

(Continued)

FOREIGN PATENT DOCUMENTS

JP 2006-263100 A † 10/2006
JP 2006263100 10/2006

(Continued)

OTHER PUBLICATIONS

Co-pending U.S. Appl. No. 14/728,786, filed Jun. 2, 2015, 63 pages.

(Continued)

*Primary Examiner* — Kang Hu
*Assistant Examiner* — Malina D Blaise
(74) *Attorney, Agent, or Firm* — DiLizio Law, PLLC

(57) ABSTRACT

A layout pattern of a plurality of possible layout patterns for wagering game machines is determined. An input indicating a location of a wagering game machine within the layout patter is received. A mapping of the wagering game machine to the location within the layout pattern is stored.

21 Claims, 9 Drawing Sheets

(56) References Cited

U.S. PATENT DOCUMENTS 6,923,724 B2 * 8/2005 Williams ..... G07F 17/32 463/40
6,935,958 B2 8/2005 Nelson
7,316,619 B2 1/2008 Nelson
8,235,816 B2 8/2012 Nelson
8,613,667 B2 12/2013 Brunell et al.
8,758,102 B2 * 6/2014 Block ..... G06Q 30/02 463/1
8,808,088 B1 8/2014 Brunell et al.
8,814,673 B1 8/2014 Brunell et al.
8,912,727 B1 12/2014 Brunell et al.
8,979,646 B2 * 3/2015 Moser ..... G06Q 30/02 463/29
9,306,952 B2 * 4/2016 Burman ..... G06Q 20/3224
9,325,203 B2 * 4/2016 Nguyen ..... H02J 9/00
2002/0152120 A1 * 10/2002 Howington ..... G06Q 30/02 705/14.11
2002/0160826 A1 * 10/2002 Gomez ..... G07F 17/32 463/16
2003/0130033 A1 7/2003 Loose
2003/0130039 A1 * 7/2003 Nelson ..... G01S 5/02 463/42
2003/0148809 A1 * 8/2003 Nelson ..... G07F 17/32 463/29
2005/0043072 A1 2/2005 Nelson
2005/0248299 A1 11/2005 Chemel et al.
2005/0277469 A1 12/2005 Pryzby et al.
2006/0079319 A1 4/2006 Aoki et al.
2006/0095790 A1 * 5/2006 Nguyen ..... G06Q 20/3224 713/186
2006/0162631 A1 * 7/2006 Hickey ..... A01B 79/005 111/200
2006/0217202 A1 9/2006 Burke et al.
2006/0252530 A1 * 11/2006 Oberberger ..... G07F 17/32 463/29
2006/0287098 A1 * 12/2006 Morrow ..... G07F 17/32 463/42
2007/0099697 A1 5/2007 Nelson
2007/0155490 A1 * 7/2007 Phillips ..... G07F 17/32 463/29
2007/0218970 A1 9/2007 Patel et al.
2007/0218974 A1 * 9/2007 Patel ..... G07F 17/3244 463/20
2008/0051198 A1 2/2008 Nelson
2008/0113715 A1 5/2008 Beadell et al.
2008/0263088 A1 * 10/2008 Webster ..... G06F 17/30241
2008/0268959 A1 * 10/2008 Bryson ..... G07F 17/32 463/42
2009/0082095 A1 3/2009 Walker et al.
2009/0124345 A1 * 5/2009 Gilmore ..... G07F 17/32 463/20
2009/0191973 A1 * 7/2009 Freele ..... G07F 17/32 463/42
2009/0253497 A1 * 10/2009 Bennett ..... G07F 17/3276 463/29
2009/0265105 A1 10/2009 Davis et al.
2009/0265707 A1 * 10/2009 Goodman ..... G06F 9/5016 718/1
2009/0305773 A1 12/2009 Gagner et al.
2010/0057930 A1 * 3/2010 DeHaan ..... H04L 67/34 709/232
2010/0069115 A1 3/2010 Liu
2010/0146394 A1 * 6/2010 Morris ..... G06F 17/30241 715/733
2010/0191369 A1 * 7/2010 Kim ..... G07F 5/18 700/235
2010/0228526 A1 * 9/2010 Moore, III ..... G06Q 30/02 703/1
2010/0234104 A1 * 9/2010 Ruppert ..... G07F 17/3232 463/30
2010/0274380 A1 * 10/2010 Gray ..... G05B 19/4097 700/104
2011/0115413 A1 * 5/2011 Erickson ..... H05B 37/029 315/312
2011/0143683 A1 * 6/2011 Sridhara ..... G01S 5/0215 455/67.16
2011/0154320 A1 * 6/2011 Verma ..... G06F 8/63 718/1
2011/0195789 A1 8/2011 Wells
2012/0129601 A1 5/2012 Gronkowski et al.
2012/0165101 A1 6/2012 Krishnamoorthy et al.
2012/0178523 A1 7/2012 Greenberg et al.
2012/0178528 A1 7/2012 Brunell et al.
2012/0225726 A1 9/2012 Anderson et al.
2013/0035168 A1 2/2013 Layne, IV
2013/0184078 A1 7/2013 Brunell et al.
2013/0225268 A1 8/2013 Caputo et al.
2013/0326505 A1 * 12/2013 Shah ..... G06F 9/455 718/1
2014/0073426 A1 3/2014 Patel et al.
2014/0073430 A1 3/2014 Brunell et al.
2014/0206432 A1 7/2014 Radek et al.
2015/0262455 A1 9/2015 Radek

FOREIGN PATENT DOCUMENTS

WO 2007103426 9/2007
WO WO 2007103426 A2 * 9/2007 ..... G07F 17/32
WO WO 2009120616 A1 * 10/2009 ..... G06Q 30/02
WO 2011056859 5/2011

OTHER PUBLICATIONS

U.S. Appl. No. 13/746,697, Radek, et al.
"PCT Application No. PCT/US10/55284 International Preliminary Report on Patentability", Mar. 28, 2012, 7 pages.
"PCT Application No. PCT/US10/55284 International Search Report", Feb. 28, 2011, 10 pages.
"U.S. Appl. No. 13/508,058 Final Office Action", Feb. 25, 2014, 16 Pages.
"U.S. Appl. No. 13/508,058 Office Action", Oct. 21, 2013, 12 Pages.
"U.S. Appl. No. 13/746,697 Office Action", Oct. 21, 2014, 15 Pages.

* cited by examiner
† cited by third party

WAGERING GAME MACHINE LAYOUT MAPPING

RELATED APPLICATIONS

This application is a divisional application that claims priority benefit of U.S. patent application Ser. No. 13/508,058 filed Nov. 3, 2010, which is a National Stage Patent Application of PCT/US10/55284 filed Nov. 3, 2010, which claims priority benefit of Provisional U.S. Patent Application No. 61/257,980 filed Nov. 4, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2014, WMS Gaming, Inc.

FIELD

Embodiments of the inventive subject matter relate generally to wagering game systems, and more particularly to wagering game machine layout mapping.

BACKGROUND

Wagering game machines (WGMs), such as slot machines, video poker machines and the like, have been a cornerstone of the gaming industry for several years. To manage a large number of wagering game machines, a casino uses a floor layout. Floor plan software can be used to create layouts of a casino floor. A user can sketch scaled down drawings of a floor layout. The floor layouts include dimensions of walls, locations of doors and windows, locations of furniture and other items. The user can also sketch locations of WGMs and other casino elements (e.g., roulette tables, poker tables, cages, signs, information kiosks, etc.) on the floor.

BRIEF DESCRIPTION OF THE FIGURES

Embodiments of the invention are illustrated in the Figures of the accompanying drawings in which.

DESCRIPTION OF THE EMBODIMENTS

Figure 1:
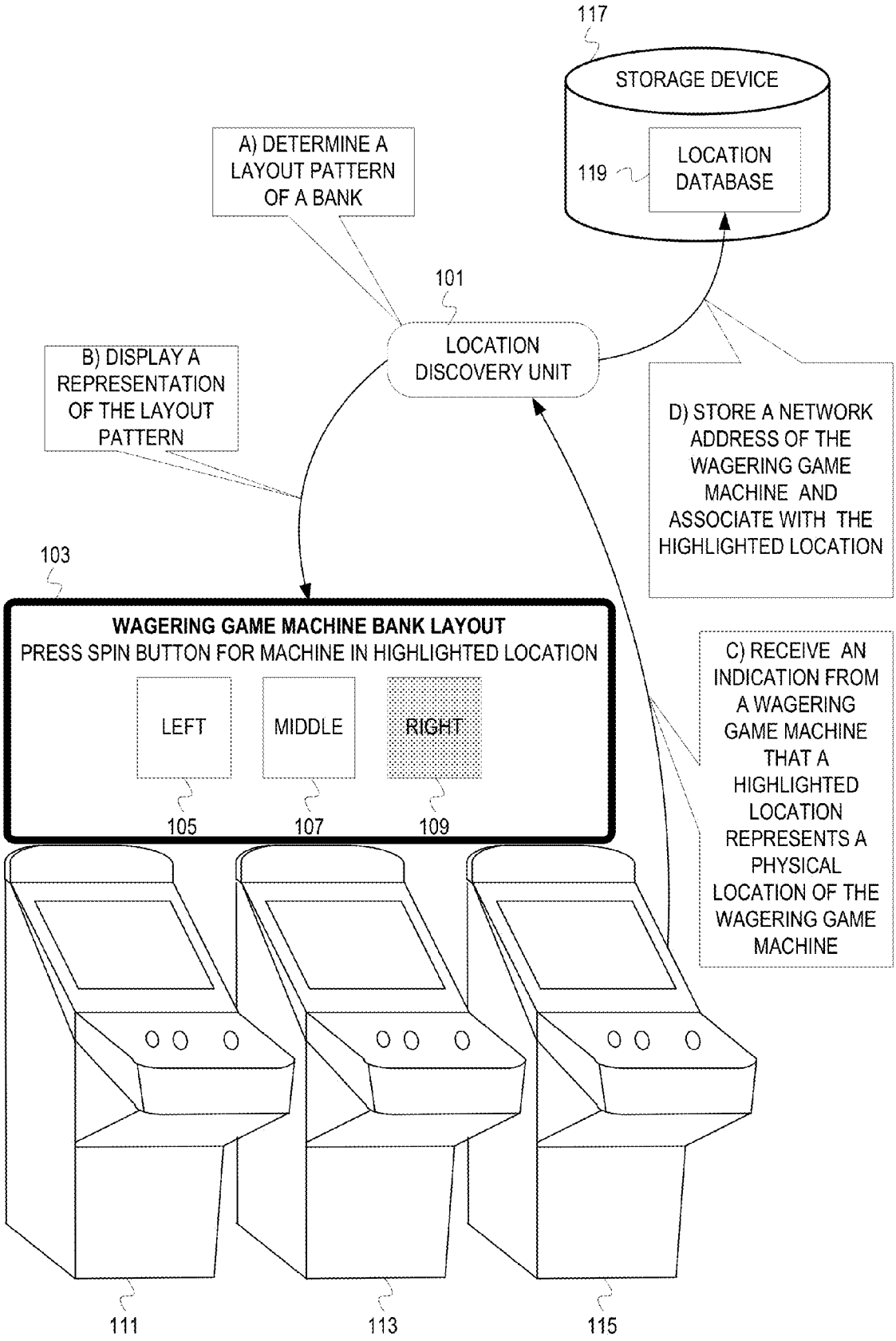
FIG. 1 is an example conceptual diagram of determining physical locations of WGMs within a WGM bank.

The description that follows includes exemplary systems, methods, techniques, instruction sequences, and computer program products that embody techniques of the present inventive subject matter. For instance, examples refer to network addresses of wagering game machines as identifying information. Embodiments are not limited to network addresses, and can identify wagering game machines with serial numbers, casino generated identifiers, hashes of network addresses, etc. However, it is understood that the described embodiments may be practiced without these specific details. Well-known instruction instances, protocols, structures, and techniques have not been shown in detail in order not to obfuscate the description.

Wagering game servers communicate with WGMs using network addresses that are assigned to the WGMs, most often without regard to physical location of the WGMs. For a wagering game server to utilize physical locations in wagering game events, a technician can manually map the WGMs' network addresses to physical locations in a representation of the WGMs' positions on a casino floor ("WGM floor layout"). Manually mapping each WGM's network address to a physical location in the layout can be time consuming and error prone.

A location discovery unit can be integrated into a wagering game server/backend/intermediary element to automatically associate WGM identifiers (e.g., network addresses) with the WGMs' physical locations in a wagering game establishment. The location discovery unit can leverage various spatial hints of a wagering game establishment floor layout (e.g., location of adjacent WGMs in a bank of WGMs, a network access point location, a partially populated data structure that partially indicates floor layout, etc.) to automatically determine physical locations of WGMs, ranging from multiple floors across multiple properties to a small area of a single floor at a single property. Spatial hints can arise from electronic floor diagrams, inputs at WGMs, leveraging a global positioning system and patron cell phones, security cameras, etc. Furthermore, automatically determined WGM floor layouts can be represented with precise geographic information (e.g., global coordinates), information within a particular context (e.g., coordinates within a casino), dynamic location information (e.g., distance of a portable wagering game machine from various waypoints), etc. Embodiments are not required to determine an exact physical location of a WGM.

For instance, a location discovery unit can determine individual WGM positions in a bank of WGMs (WGM bank layout). The location discovery unit or another process/program/agent can display an unpopulated/incomplete representation of the WGM bank layout ("layout pattern") and prompt a technician for input at one of the WGMs (e.g., pressing a spin button, touching an area of a screen, etc.) that corresponds to the physical location of the WMG in the WGM bank layout. The prompt can provide multiple input choices for the technician, with each input choice corresponding to a physical location within the WGM bank layout. The location discovery unit receives an indication of the physical location that corresponds to the input and a network address of the WGM. The location discovery unit associates the network address with the physical location. The location of the WGM within the bank is known, but the exact location within a casino may not be known.

FIG. 1 is an example conceptual diagram of determining physical locations of WGMs within a WGM bank. A bank of WGMs comprises a WGM 111, a WGM 113, and a WGM 115. At stage A, a location discovery unit 101 determines a layout pattern of the bank. The layout pattern can comprise a configuration of physical locations that represent positions of WGMs in the bank. Example configurations comprise straight lines, circles, back-to-back rows, curved lines, etc. Determining the layout pattern of the bank can involve determining a number of WGMs in the bank. For example, the location discovery unit can determine the number of WGMs based on input from a technician. As another example, a wagering game server that controls the bank can report the number of WGMs connected to the wagering game server. The location discovery unit can display a plurality of potential layout patterns based on the number of WGMs, and prompt a technician to specify one of the plurality of potential layout patterns that best matches the configuration of the WGM bank. In this example, the WGMs 111, 113, and 115 are configured in a line, so the layout pattern comprises a left physical location 105, a middle physical location 107, and a right physical location 109.

At stage B, the location discovery unit 101 displays a representation of the layout pattern. In this example, the location discovery unit 101 displays the representation of the layout pattern on an overhead display 103 associated with the bank. In other examples, the location discovery unit 101 may display the representation on individual displays of one or more WGMs in the bank, on a portable device (e.g., phone, handheld computer, etc.), etc.

At stage C, the location discovery unit 101 receives an indication from a WGM that a highlighted location in the representation represents a physical location of the WGM. The indication is sent in response to the technician pressing a spin button on the WGM in the highlighted location. In this example, the location discovery unit 101 highlighted the rightmost physical location 109 (from the perspective of the technician). The WGM 115 transmits the indication to the location discovery unit 101 in response to the technician pressing the spin button. The location discovery unit 101 can determine the WGM's network address from the indication, so that the location discovery unit 101 can associate the network address with the physical location in the layout pattern. The location discovery unit 101 can determine the remaining WGMs' physical locations by highlighting each of the remaining physical locations 105 and 107 and prompting for input from the technician. The location discovery unit 101 can also determine the remaining WGMs' physical locations without input from a technician. For example, the location discovery unit 101 can automatically determine the location of the WGM 111 if the location discovery unit 101 already knows the locations of the other WGMs 113 and 115 in the bank. The location discovery unit previously determined, that the WGM 113 and the WGM 109 correspond to the middle physical position 107 and the right physical position 109, respectively. The left physical location 105 is the only remaining physical location not associated with a network address. The WGM 111 is the only remaining WGM in the bank, so the location discovery unit 101 automatically associates the WGM 111 with the left physical location 105.

At stage D, the location discovery unit 101 stores the network address of the WGM 115 determined with the received indication and associates the highlighted location 109 with the network address in a location database 119. A storage device 117 hosts the location database 119. A wagering game server may host the storage device 117. The storage device 119 may be standalone device or may be hosted on another server. Various techniques are possible for communicating a WGM identifier to the location discovery unit. For instance, the location discovery unit 101 may read the network address of the WGM 115 from the received indication. But embodiments can also supply an identifier of the WGM 115 (e.g., serial number, network address, machine name, etc.) with a separate communication and a reference to the previously transmitted indication.

Figure 2:
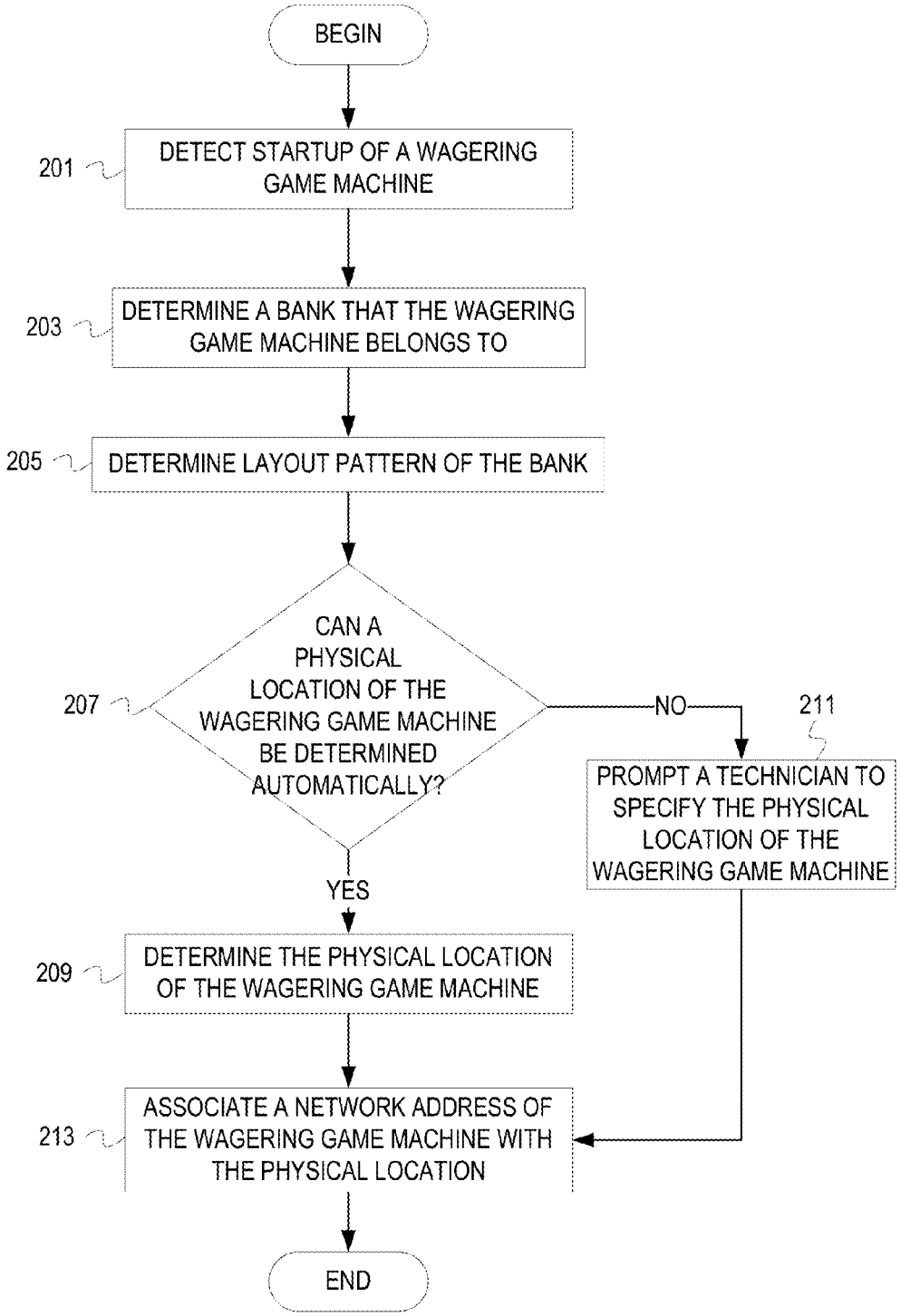
FIG. 2 is a flowchart of example operations for determining physical locations of WGMs within a WGM bank.

FIG. 2 is a flowchart of example operations for determining physical locations of WGMs within a WGM bank. Flow begins at block 201, where startup of a WGM is detected. For example, a wagering game server in a network determines that a new WGM has been connected to the network.

At block 203, a bank that the WGM belongs to is determined. For example, a location discovery unit determines the bank based on a prefix of a network address assigned to the WGM. As another example, the bank is determined based on the WGM's network access point location.

At block 205, a layout pattern of the bank is determined. The layout pattern comprises a group of physical locations that represent a configuration of WGMs in the bank. For example, the layout pattern is determined based on a selection made by a technician. The technician can select the layout pattern from potential layout patterns or the technician can create a new layout pattern if none of the potential layout patterns matches the configuration of the WGMs in the bank. The technician can create the pattern on one of the WGMs, on a mobile phone, a personal digital assistant, etc. As another example, the layout pattern of the bank may be determined based on an existing map of a casino floor. As another example, the layout pattern may be determined by utilizing overhead cameras.

At block 207, it is determined if the WGM's physical location can be determined automatically. For example, the WGM's physical location can be determined automatically if physical locations of all the other WGMs in the bank have previously been determined. A location discovery unit would automatically determine that the WGM' physical location is the last unassociated physical location in the layout pattern. As another example, the WGM's physical location can be automatically determined if an overhead camera can be used to detect an image displayed by the WGM. If the physical location can be determined automatically, flow continues at block 209. If the physical location cannot be determined automatically, flow continues at block 211.

At block 209, the physical location of the WGM is determined. For example, only one physical location in the layout pattern has not been associated with any WGM, so the one physical location corresponds to the WGM. As another example, a location discovery unit can use the WGM's network address to instruct the WGM to display an image. The location discovery unit can utilize an overhead camera to locate the WGM based on recognition of the image and record an identifier attached to the top of the WGM. The location discovery unit can then associate the network address with the physical location based on locating the identifier in the layout pattern. As another example, the WGMs may be outfitted with global positioning system (GPS) receivers. The physical location may be determined based on GPS coordinates. As another example, the physical location may be determined based on locations of patrons' mobile phones. When a player inserts a player tracking card into the WGM, the system can use player account data to determine the player's mobile phone number, and then the location discovery unit can utilize mobile phone signals to triangulate the location of the player's mobile phone in the casino. In addition, the location discovery unit may also determine the location of the WGM based on GPS data from the mobile phone.

At block 211, a technician is prompted to specify the physical location of the WGM. For example, a representation of the layout pattern is displayed on the WGM and the technician is prompted to select an appropriate physical location in the representation.

At block 213, a network address of the WGM is associated with the physical location in the layout pattern. For example, the network address is stored in an entry of a location database that corresponds to the physical location.

A location discovery unit can determine physical locations of WGMs based on wireless signals that can be transmitted and received by the WGMs. For example, a location discovery unit can instruct a first WGM with a known physical location to emit a sound. The sound can be received by a second WGM with an unknown physical location. A distance between the first and second WGMs can be computed based on a time of arrival of the sound. The location discovery unit can use the distance to associate the second WGM with a physical location in a layout of WGMs.

Figure 3:
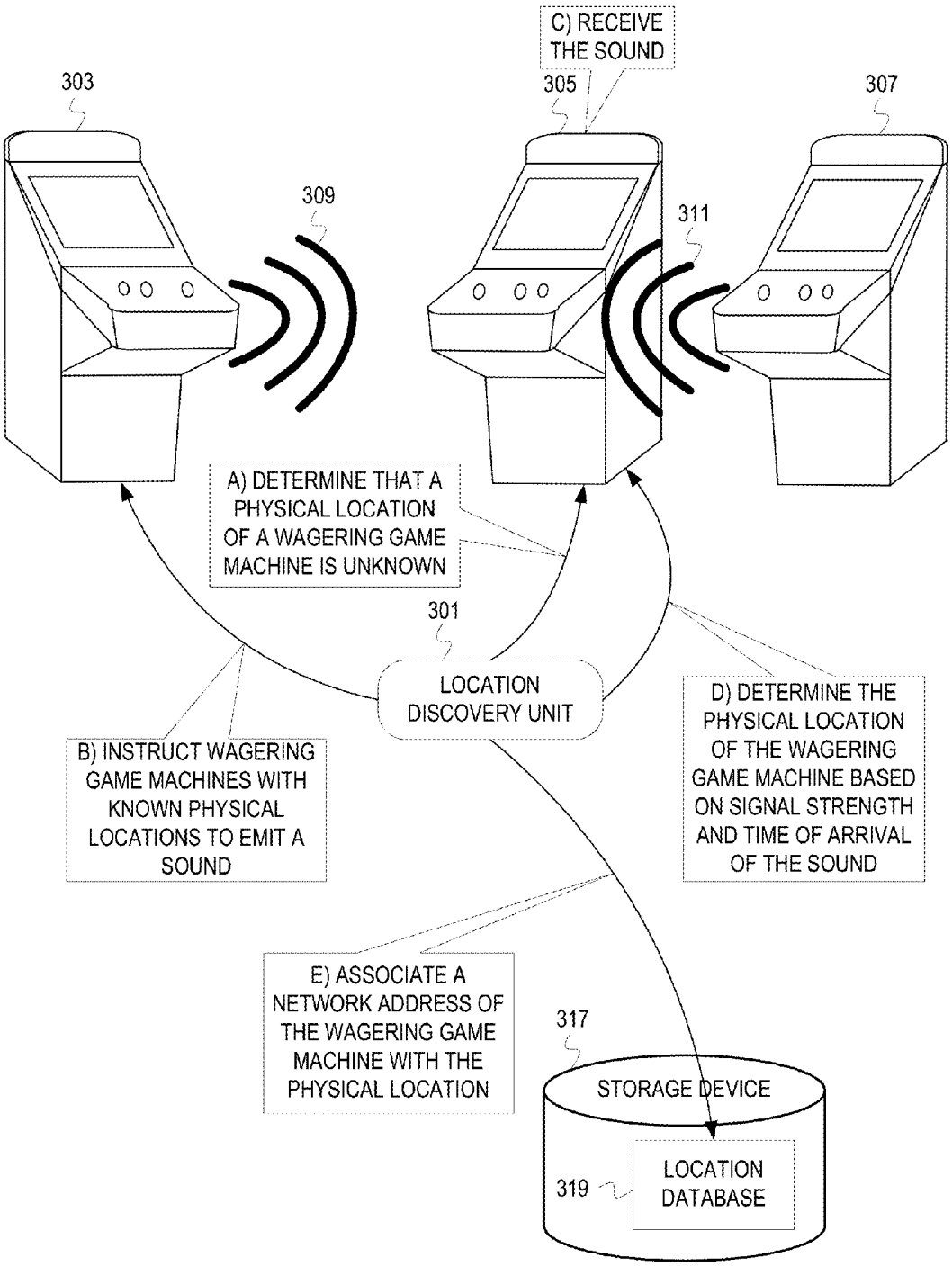
FIG. 3 is an example conceptual diagram of determining physical locations of WGMs with sound.

FIG. 3 is an example conceptual diagram of determining physical locations of WGMs with sound. A WGM 303, a WGM 305, and a WGM 307 are positioned on a casino floor. At stage A, a location discovery unit 301 determines that a physical location of the WGM 305 is unknown. For example, the location discovery unit 301 accesses a location database 319 and determines that the location database 319 does not contain an entry for the WGM 305.

At stage B, the location discovery unit 301 instructs WGMs with known physical locations to emit a sound one by one. In this example, the known WGMs comprise the WGM 303 and the WGM 307. The location discovery unit 301 instructs the WGM 303 to emit a sound for a certain time period. Once the time period has expired, the location discovery unit instructs WGM 307 to emit a sound for the same time period.

At stage C, the WGM 305 receives the sounds emitted by both WGM 303 and WGM 307. The WGM 305 determines a signal strength and a time of arrival for each sound. Although this example refers to sound, embodiments are not so limited. Embodiments can use other types of signals, such as radio-frequency identification (RFID) signals, Institute of Electrical and Electronics Engineers' (IEEE) 802.11 (Wi-Fi) signals, etc.

At stage D, the location discovery unit 301 determines the physical location of the WGM 305 based on the signal strengths and times of arrival of the sounds. For example, the location discovery unit 301 computes distances from WGM 303 and WGM 307 based on the times of arrival. The location discovery unit 301 determines that the WGM 305 is closer to the WGM 307 based on the times of arrival. The location discovery unit 301 determines an orientation of the WGM 305 based on the signal strengths. The location discovery unit 301 can determine coordinates that represent the position and orientation of the WGM on the casino floor. The location discovery unit 301 can utilize the coordinates to determine the physical location from a layout pattern of the casino floor. In addition, receivers at the WGM 305 can determine angles of arrival of the signals from the WGMs 303, 307. The location discovery unit 301 and/or code running on the WGM 305 can use the angles of arrival to determine location and/or orientation of the WGMs 303, 307. Moreover, the WGM 305 can be implemented with multiple receivers located at different locations on the WGM 305. The location discovery unit 301 can use attributes of a signal at the different receivers (e.g., different times of arrival, different signal strengths, etc.) to determine or refine location data of the WGMs 303, 307. The location discovery unit 301 can determine a layout pattern of the WGMs based on the signals. The location discovery unit 301 can determine orientation and location of the multiple WGMs and ascertain layout.

At stage E, the location discovery unit 301 associates a network address of the WGM 305 with the physical location in the location database 319.

Figure 4:
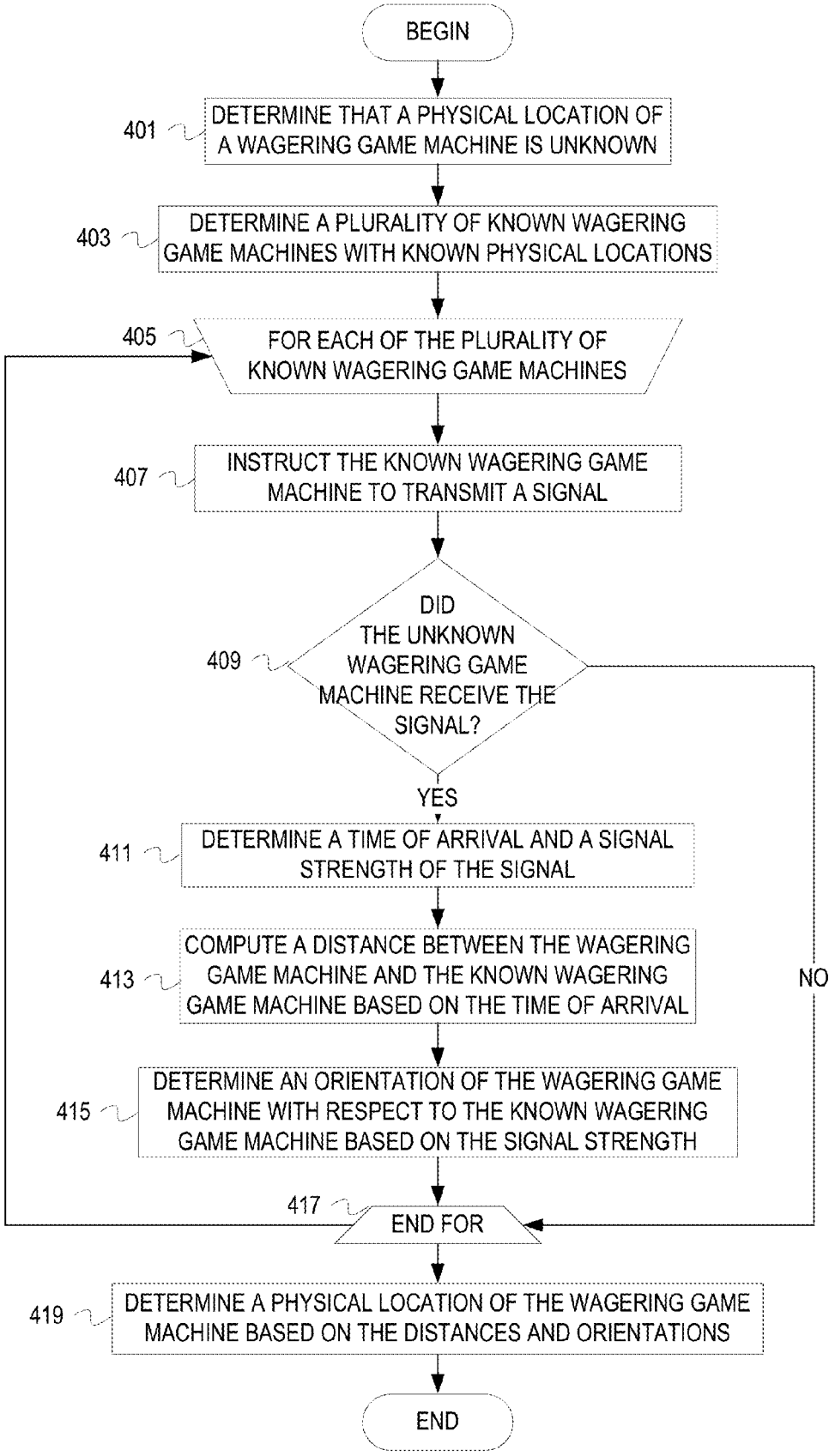
FIG. 4 is a flowchart depicting example operations for determining physical locations of WGMs with wireless signals.

FIG. 4 is a flowchart depicting example operations for determining physical locations of WGMs with wireless signals. Flow begins at block 401, where it is determined that a physical location of a WGM is unknown.

At block 403, a plurality of known WGMs with known physical locations is determined. For example, a location discovery unit determines the plurality of known WGMs based on associations with physical locations in a location database.

At block 405, a loop begins for each of the plurality of known WGMs.

At block 407, the known WGM is instructed to transmit a signal for a certain time period. Examples of signals include sound, RFID, Wi-Fi, etc. In a case where none of the WGMs physical locations are known, a signal can be transmitted from another location within the casino such as a concierge desk, a cage, etc. In addition, a technician may also specify the physical location of at least one WGM.

At block 409, it is determined if the unknown WGM received the signal within the time period. If the unknown WGM did not receive the signal within the time period, the unknown WGM may be too far from the known WGM. If the unknown WGM received the signal, flow continues at block 411. If the unknown WGM did not receive the signal, flow continues at block 417.

At block 411, a time of arrival and a signal strength of the signal are determined. For example, the location discovery unit computes the time of arrival by subtracting a transmitted time from a received time. The location discovery unit computes the signal strength based on a magnitude of the received signal.

At block 413, a distance between the unknown WGM and the known WGM is computed based on the time of arrival.

At block 415, an orientation, with respect to the known WGM, of the unknown WGM is determined based on the signal strength. For example, a strong signal strength indicates that a receiver on the unknown WGM is pointed at the unknown WGM.

At block 417, the loop ends.

At block 419, a physical location of the wagering game machine is determined based on the distances and orientations. For example, the location discovery unit determines a best match physical location from a layout pattern based on the distances and orientations. The flow ends after block 419.

Although some examples assume a known floor layout, a layout of WGMs on a casino floor may not be known. For example, the layout may not be known when a new bank of WGMs has recently been placed on the floor. A location discovery unit can utilize overhead cameras in a casino to automatically discover a layout pattern of WGMs. The overhead cameras can determine the layout pattern of the WGMs based on labels affixed to the tops of the WGMs. The location discovery unit can associate each physical location in the layout pattern with a WGM identifier shown on the WGM's label. The location discovery unit can also utilize the overhead cameras to associate the WGMs' network addresses with physical locations in the layout pattern. For example, the location discovery unit can instruct a WGM at a particular network address to display an image. The overhead cameras can recognize the image and record an identifier shown on the WGM's label, or in the image. The location discovery unit can associate the network address with a physical location in the layout pattern based on the recorded identifier.

Figure 5:
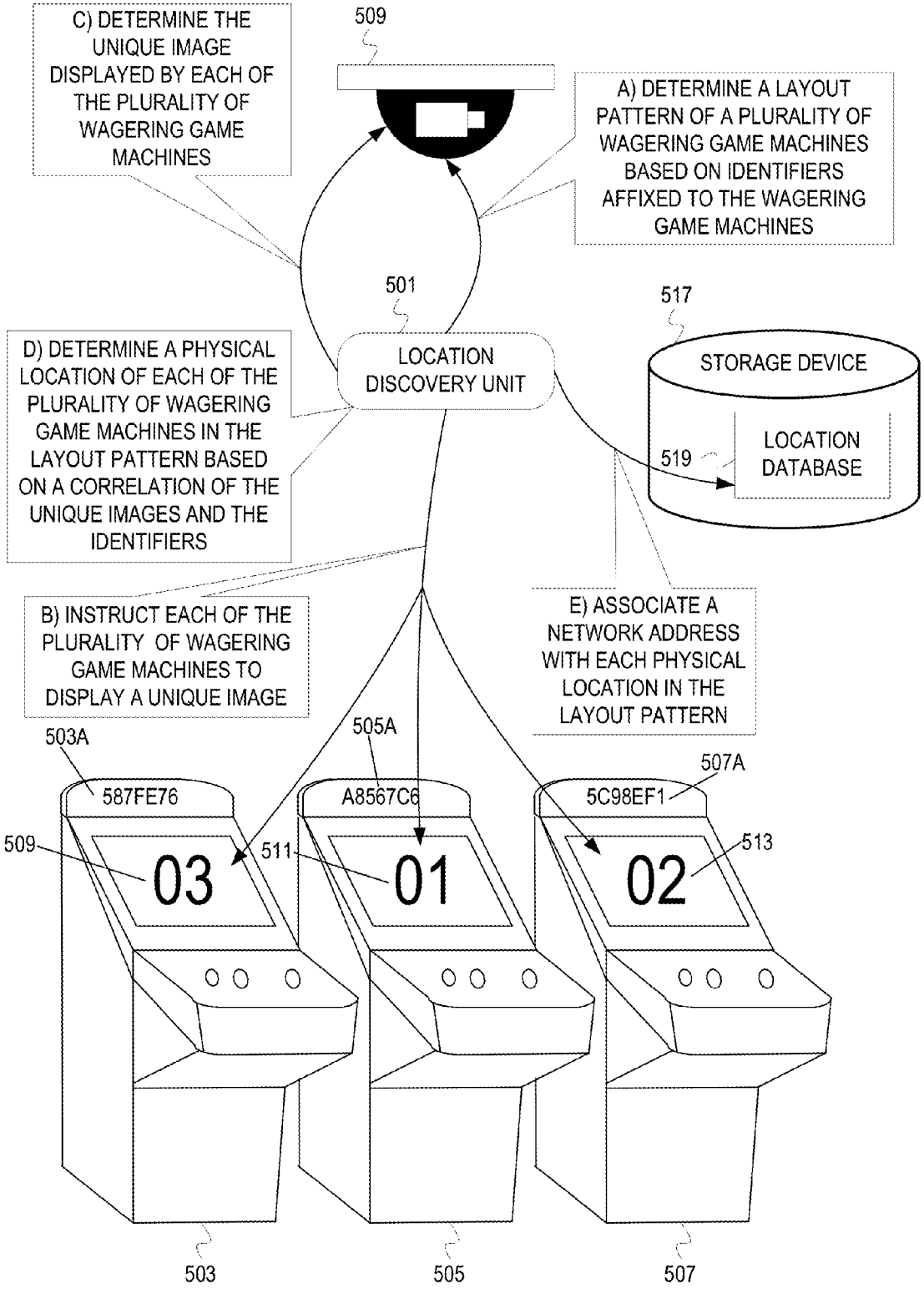
FIG. 5 is an example conceptual diagram of automatically discovering a layout of WGMS on a casino floor and determining physical locations of each WGM within the layout.

FIG. 5 is an example conceptual diagram of automatically discovering a layout of WGMs on a casino floor and determining physical locations of each WGM within the layout. A bank of WGMs comprises a WGM 503, a WGM 505, and a WGM 507. The tops of WGMs 503, 505, and 507 are labeled with unique identifiers 503A, 505A, and 507A, respectively. The identifiers are visible to an overhead camera 509 in the casino and can be used by imaging software and/or casino personnel to locate a particular WGM on the casino floor. Although a single overhead camera 509 is depicted in FIG. 5, the overhead camera 509 may represent an array of overhead cameras.

At stage A, a location discovery unit 501 determines a layout pattern of a plurality of WGMs based on identifiers affixed to the WGMs. Determining the layout pattern of the plurality of WGMs can comprise determining the plurality of WGMs that are visible to the overhead camera 509. In this example, the WGMs 503, 505, and 507 are visible to the overhead camera 509. The location discovery unit 501 can determine identifiers of the plurality of WGMs based on optical recognition of labels affixed to the tops of the plurality of WGMs. In this example, the location discovery unit 501 determines that the identifier 503A is "587FE76," the identifier 505A is "A8567C6," and the identifier 507A is "5C98EF1" using optical character recognition (OCR). The location discovery unit 501 can determine a configuration of the plurality of WGMs based on positions of each of the plurality of WGMs and orientations of the affixed labels. The layout pattern comprises a group of physical locations that represent the configuration. Each of the physical locations in the layout pattern is associated with one of the identifiers. In this example, the identifiers comprise characters printed on labels affixed to the WGMs. In other examples, the identifiers may comprise unique images etched into the front of the WGMs, serial numbers affixed to the WGMS, logos painted on the WGMs, and combinations thereof.

At stage B, the location discovery unit 501 instructs the WGMs 503, 505, and 507 to display unique images. The location discovery unit 501 transmits a representation of one unique image to each WGM 503, 505, and 507 based on network addresses of the WGMs 503, 505, and 507. In this example, the location discovery unit 501 instructs the WGM 503 to display a "03" image 509, the WGM 505 to display a "01" image 511, and the WGM 507 to display a "02" image 513.

At stage C, the location discovery unit 501 determines the unique image displayed by each of the plurality of WGMs based on optical recognition by the overhead camera 509. The overhead camera 509 recognizes the images and correlates each of the unique images with identifiers affixed to each of the plurality of WGMs.

At stage D, the location discovery unit 501 determines a physical location of each of the plurality of WGMs in the layout pattern based on the correlations of the unique images and identifiers. The unique images correspond to network addresses of each of the plurality of WGMs, so the location discovery unit can determine physical locations in the layout pattern based on associations with the identifier.

At stage E, the location discovery unit 501 associates a network address with each physical location in the layout pattern. For example, the location discovery unit 501 determines that the overhead camera 509 correlated the unique image "01" 511 with an identifier 505A. So, the location discovery unit 501 determines a physical location in the layout pattern associated with the identifier 505A. Then, the location discovery unit 501 associates the network address of WGM 505 with the physical location based on the correlation to the unique image 511.

Figure 6:
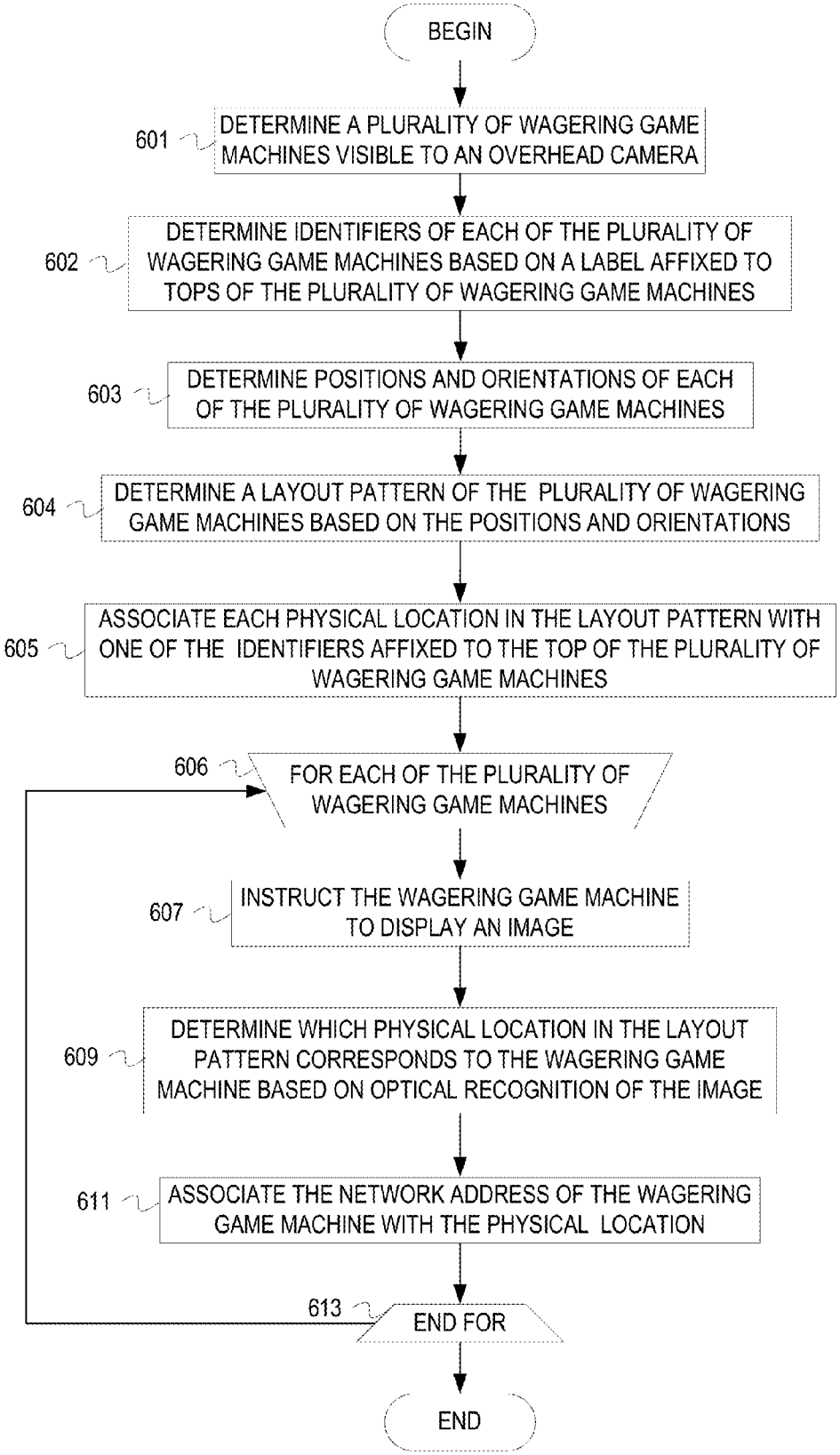
FIG. 6 is a flowchart of example operations for automatically discovering a layout of WGMS on a casino floor and determining physical locations of each WGM within the layout.

FIG. 6 is a flowchart of example operations for automatically discovering a layout of WGMs on a casino floor and determining physical locations of each WGM within the layout. Flow begins at block 601, where a plurality of WGMs visible to an overhead camera are determined.

At block 602, identifiers of each of the plurality of WGMs are determined based on labels affixed to the tops of the plurality of WGMs. The identifiers may be determined based on OCR.

At block 603, positions and orientations of each of the plurality of WGMs are determined. The positions can be determined based on a distance between a known point and each of the plurality of WGMs as measured by the overhead camera. The orientations can be determined based on orientations of the affixed labels as determined by the overhead camera. Embodiments can also determine orientation based on information encoded in the identifiers or labels.

At block 604, a layout pattern of the plurality of WGMs is determined based on the positions and orientations. For example, a location discovery unit creates a map showing the positions of the plurality of WGMs in relation to another with an indication of the orientation of each of the WGMs. The positions in the map represent a group of physical locations.

At block 605, each physical location in the layout pattern is associated with one of the identifiers that are affixed to the top of the plurality of WGMs. For example, the identifiers are stored in a location database referenced by the physical locations.

At block 606, a loop begins for each of the plurality of WGMs.

At block 607, the WGM is instructed to display an image. For example, a location discovery unit instructs the WGM to display a monitor test pattern by sending a message to the WGM's network address.

At block 609, a physical location in the layout pattern corresponding to the WGM is determined based on optical recognition of the image. For example, the overhead camera recognizes the image on a display of the WGM and records the identifier affixed to the top of the WGM.

At block 611, the network address of the WGM is associated with the physical location. For example, the location discovery unit locates a physical location in the location database based on the identifier recorded by the overhead camera. The location discovery unit then stores the network address of the WGM in an entry representing the physical location in the location database.

At block 613, the loop ends and flow ends.

Although examples refer to utilizing overhead cameras to determine physical locations of WGMs on a casino floor, embodiments are not so limited. For example, the overhead cameras can be used to determine physical locations of banks of WGMs on the casino floor. Within the bank, each WGM's physical location may be determined based on wireless signaling, cameras, technician input, etc. Furthermore, embodiments are not limited to cameras or signals. Embodiments can utilize sensors placed on the sides, front, bottom, and/or back of a wagering game machine. Examples of sensors include low power RFID sensors, light sensors, barcode readers, magnetic sensors, etc. For example, light emitting units and light sensors can be affixed onto or built into WGMs. When the WGMs are placed within a threshold distance, the light sensors can detect light from the light emitting units. As another example, bar codes and bar code readers can be affixed onto WGMs. When WGMs are placed within a threshold reading distance, the barcode reader can read identifying information from a barcode on a neighboring WGM. In addition to the detection of a neighboring WGM, the sensors can be associated with information that identifies the location of the sensor on a WGM (e.g., bottom right, front, etc.). The location information associated with a sensor can vary in granularity (e.g., right side or X and Y coordinates in millimeters of the sensor on a plane that encompasses the right side).

Operating Environment

This section describes an example operating environment and presents structural aspects of some embodiments. This section includes discussion about wagering game machine architectures, and wagering game networks.

Wagering Game Machine Architectures

Figure 7:
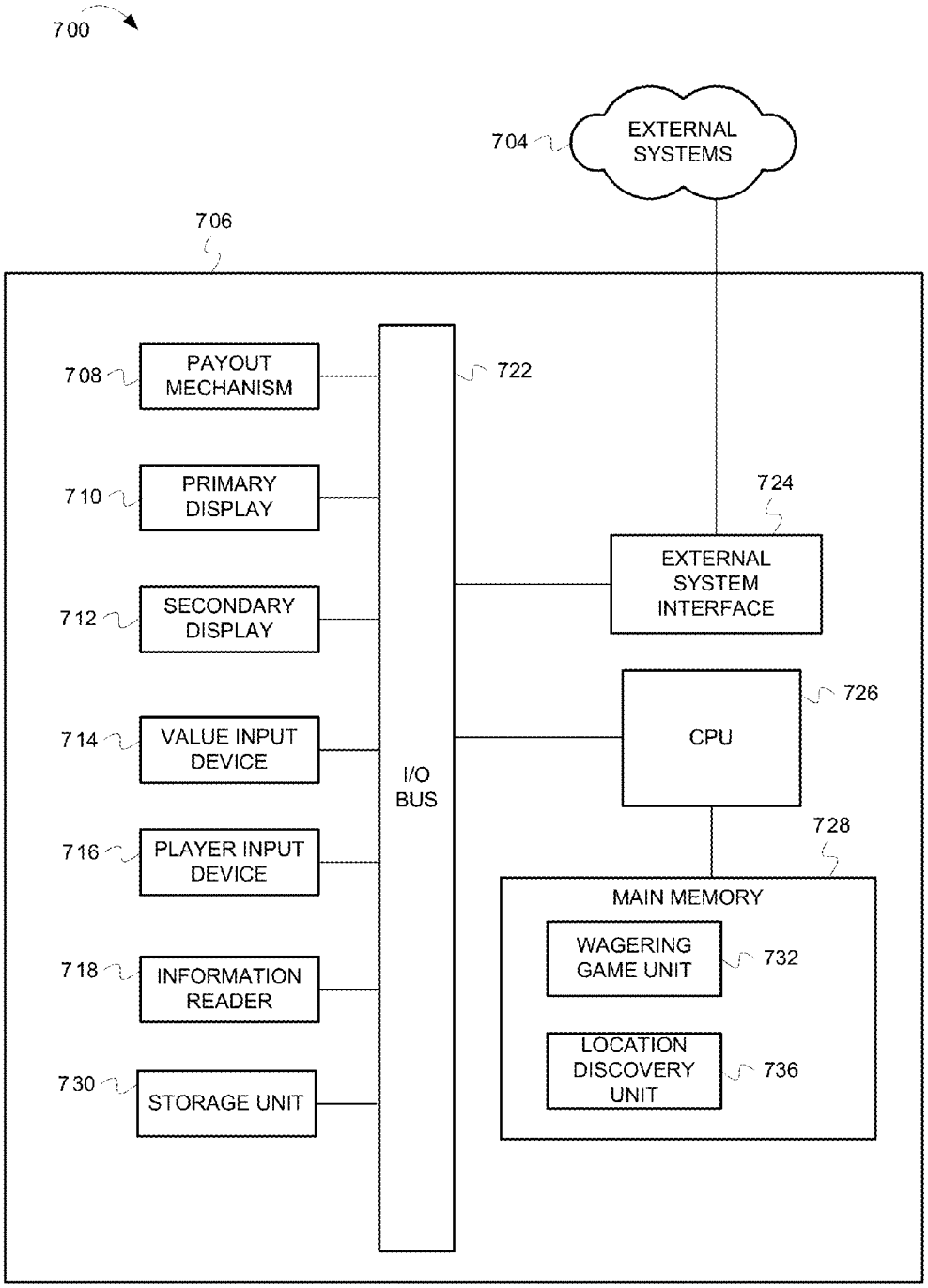
FIG. 7 is a block diagram illustrating a wagering game machine architecture, according to example embodiments of the invention.

FIG. 7 is a block diagram illustrating a wagering game machine architecture, according to example embodiments of the invention. As shown in FIG. 7, the wagering game machine architecture 700 includes a wagering game machine 706, which includes a central processing unit (CPU) 726 connected to main memory 728. The CPU 726 can include any suitable processor, such as an Intel® Pentium processor, Intel® Core 2 Duo processor, AMD Opteron™ processor, or UltraSPARC processor. The main memory 728 includes a wagering game unit 732. In one embodiment, the wagering game unit 732 can present wagering games, such as video poker, video black jack, video slots, video lottery, etc., in whole or part. The main memory 728 also includes a location discovery unit 736. The location discovery unit 736 determines a physical location of the wagering game machine 706 and associates the wagering game machine's 706 network address with the physical location in a location database.

The CPU 726 is also connected to an input/output (I/O) bus 722, which can include any suitable bus technologies, such as an AGTL+ frontside bus and a PCI backside bus. The I/O bus 722 is connected to a payout mechanism 708, primary display 710, secondary display 712, value input device 714, player input device 716, information reader 718, and storage unit 730. The player input device 716 can include the value input device 714 to the extent the player input device 716 is used to place wagers. The I/O bus 722 is also connected to an external system interface 724, which is connected to external systems 704 (e.g., wagering game networks).

In one embodiment, the wagering game machine 706 can include additional peripheral devices and/or more than one of each component shown in FIG. 7. For example, in one embodiment, the wagering game machine 706 can include multiple external system interfaces 724 and/or multiple CPUs 726. In one embodiment, any of the components can be integrated or subdivided.

Any component of the architecture 700 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 7 describes an example wagering game machine architecture, this section continues with a discussion wagering game networks.

Wagering Game Networks

Figure 8:
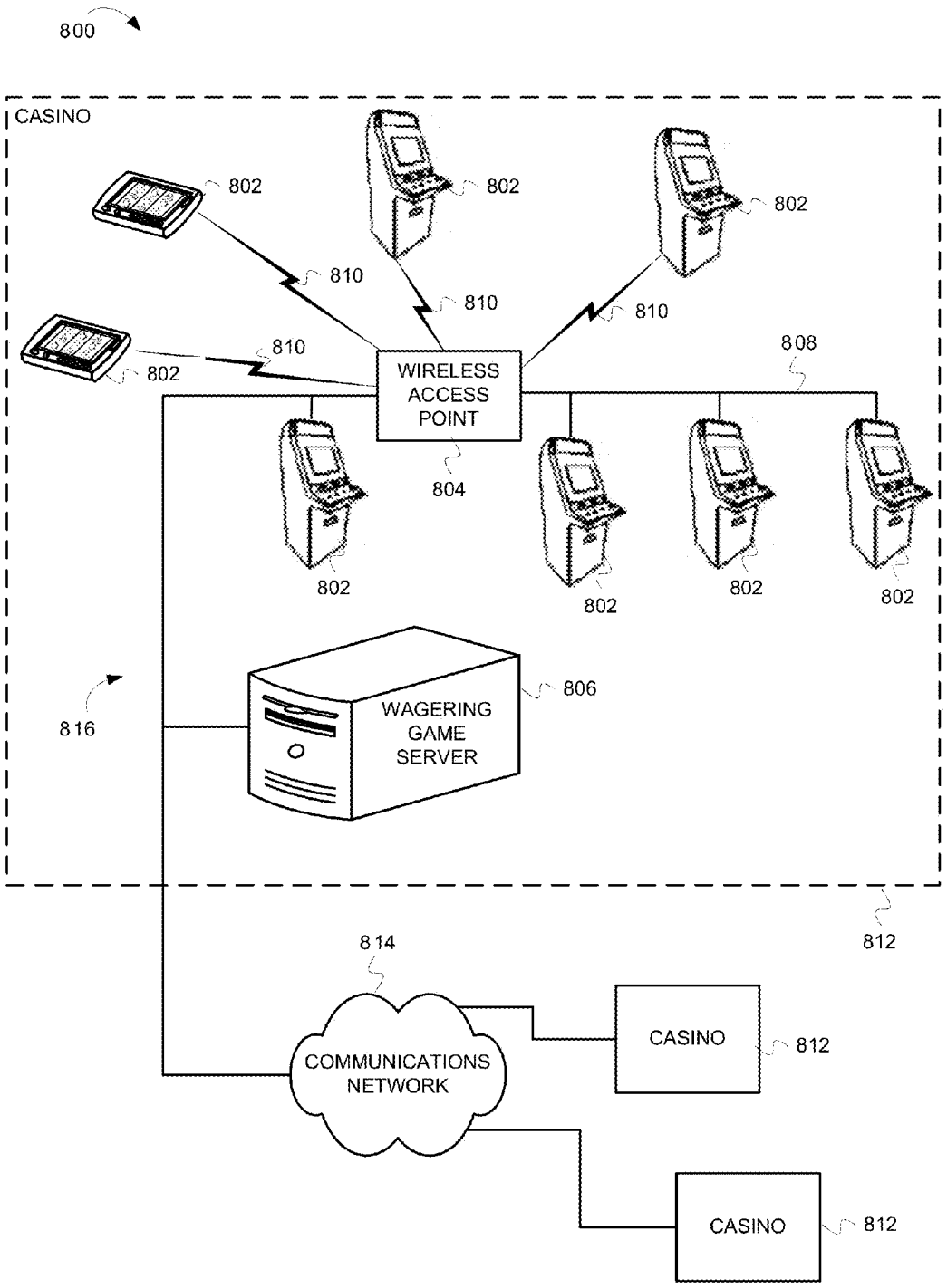
FIG. 8 is a block diagram illustrating a wagering game network 800, according to example embodiments of the invention.

FIG. 8 is a block diagram illustrating a wagering game network 800, according to example embodiments of the invention. As shown in FIG. 8, the wagering game network 800 includes a plurality of casinos 812 connected to a communications network 814.

Each casino 812 includes a local area network 816, which includes an access point 804, a wagering game server 806, and wagering game machines 802. The access point 804 provides wireless communication links 810 and wired communication links 808. The wired and wireless communication links can employ any suitable connection technology, such as Bluetooth, 802.11, Ethernet, public switched telephone networks, SONET, etc. In some embodiments, the wagering game server 806 can serve wagering games and distribute content to devices located in other casinos 812 or at other locations on the communications network 814.

The wagering game machines 802 described herein can take any suitable form, such as floor standing models, bartop models, workstation-type console models, etc. In one embodiment, the wagering game network 800 can include other network devices, such as accounting servers, wide area progressive servers, player tracking servers, and/or other devices suitable for use in connection with embodiments of the invention.

In some embodiments, wagering game machines 802 and wagering game servers 806 work together such that a wagering game machine 802 can be operated as a thin, thick, or intermediate client. For example, one or more elements of game play may be controlled by the wagering game machine 802 (client) or the wagering game server 806 (server). Game play elements can include executable game code, lookup tables, configuration files, game outcome, audio or visual representations of the game, game assets or the like. In a thin-client example, the wagering game server 806 can perform functions such as determining game outcome or managing assets, while the wagering game machine 802 can present a graphical representation of such outcome or asset modification to the user (e.g., player). In a thick-client example, the wagering game machines 802 can determine game outcomes and communicate the outcomes to the wagering game server 806 for recording or managing a player's account.

In some embodiments, either the wagering game machines 802 (client) or the wagering game server 806 can provide functionality that is not directly related to game play. For example, account transactions and account rules may be managed centrally (e.g., by the wagering game server 806) or locally (e.g., by the wagering game machine 802). Other functionality not directly related to game play may include power management, presentation of advertising, software or firmware updates, system quality or security checks, etc. In addition, automatic WGM location discovery/mapping functionality can be implemented on the wagering game server 806. Embodiments may utilize a non-wagering game server machine to implement a location discovery unit as described herein.

Any of the wagering game network components (e.g., the wagering game machines 802) can include hardware and machine-readable media including instructions for performing the operations described herein.

Example Wagering Game Machines

Figure 9:
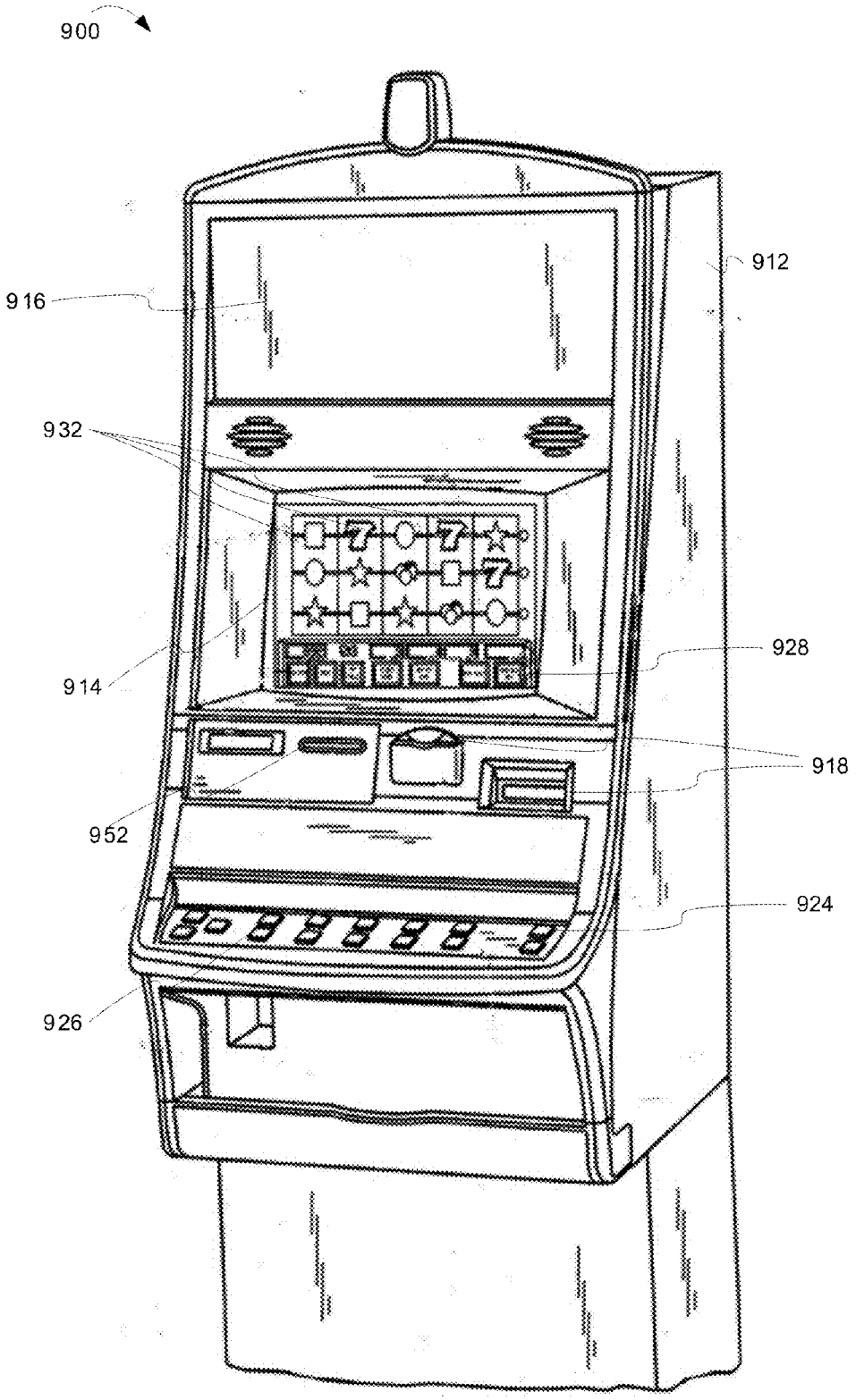
FIG. 9 is a perspective view of a wagering game machine, according to example embodiments of the invention.

FIG. 9 is a perspective view of a wagering game machine, according to example embodiments of the invention. Referring to FIG. 9, a wagering game machine 900 is used in gaming establishments, such as casinos. According to embodiments, the wagering game machine 900 can be any type of wagering game machine and can have varying structures and methods of operation. For example, the wagering game machine 900 can be an electromechanical wagering game machine configured to play mechanical slots, or it can be an electronic wagering game machine configured to play video casino games, such as blackjack, slots, keno, poker, blackjack, roulette, etc.

The wagering game machine 900 comprises a housing 912 and includes input devices, including value input devices 918 and a player input device 924. For output, the wagering game machine 900 includes a primary display 914 for displaying information about a basic wagering game. The primary display 914 can also display information about a bonus wagering game and a progressive wagering game. The wagering game machine 900 also includes a secondary display 916 for displaying wagering game events, wagering game outcomes, and/or signage information. The primary display 914 and/or secondary display 916 can also display representations of layout patterns so that a physical location of the wagering game machine 900 can be specified. While some components of the wagering game machine 900 are described herein, numerous other elements can exist and can be used in any number or combination to create varying forms of the wagering game machine 900.

The value input devices 918 can take any suitable form and can be located on the front of the housing 912. The value input devices 918 can receive currency and/or credits inserted by a player. The value input devices 918 can include coin acceptors for receiving coin currency and bill acceptors for receiving paper currency. Furthermore, the value input devices 918 can include ticket readers or barcode scanners for reading information stored on vouchers, cards, or other tangible portable storage devices. The vouchers or cards can authorize access to central accounts, which can transfer money to the wagering game machine 900.

The player input device 924 comprises a plurality of push buttons on a button panel 926 for operating the wagering game machine 900. In addition, or alternatively, the player input device 924 can comprise a touch screen 928 mounted over the primary display 914 and/or secondary display 916.

The various components of the wagering game machine 900 can be connected directly to, or contained within, the housing 912. Alternatively, some of the wagering game machine's components can be located outside of the housing 912, while being communicatively coupled with the wagering game machine 900 using any suitable wired or wireless communication technology.

The operation of the basic wagering game can be displayed to the player on the primary display 914. The primary display 914 can also display a bonus game associated with the basic wagering game. The primary display 914 can include a cathode ray tube (CRT), a high resolution liquid crystal display (LCD), a plasma display, light emitting diodes (LEDs), or any other type of display suitable for use in the wagering game machine 900. Alternatively, the primary display 914 can include a number of mechanical reels to display the outcome. In FIG. 9, the wagering game machine 900 is an "upright" version in which the primary display 914 is oriented vertically relative to the player. Alternatively, the wagering game machine can be a "slant-top" version in which the primary display 914 is slanted at about a thirty-degree angle toward the player of the wagering game machine 900. In yet another embodiment, the wagering game machine 900 can exhibit any suitable form factor, such as a free standing model, bartop model, or workstation console model.

A player begins playing a basic wagering game by making a wager via the value input device 918. The player can initiate play by using the player input device's buttons or touch screen 928. The basic game can include arranging a plurality of symbols along a payline 932, which indicates one or more outcomes of the basic game. Such outcomes can be randomly selected in response to player input. At least one of the outcomes, which can include any variation or combination of symbols, can trigger a bonus game.

In some embodiments, the wagering game machine 900 can also include an information reader 952, which can include a card reader, ticket reader, bar code scanner, RFID transceiver, or computer readable storage medium interface. In some embodiments, the information reader 952 can be used to award complimentary services, restore game assets, track player habits, etc. The wagering game machine 900 can also comprise other devices to assist in automatic layout mapping (e.g., microphones, cameras, etc.). A location discovery unit can utilize the components/devices of the wagering game machine 900, such as the RFID transceiver, to determine a physical location of the wagering game machine 900.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method of operating a gaming system, said method comprising:

providing, via an electronic gaming network, for presentation at a wagering game machine of a plurality of wagering game machines, a potential bank layout pattern for a bank of related wagering game machines, wherein the potential bank layout pattern presents, according to a configuration requirement, a number of graphics that represent a required number of wagering game machines laid out in a specific orientation relative to each other for play of one or more features of an electronic wagering game, and wherein the wagering game machine includes a value input device configured to receive physical money to increase a credit balance for placement of one or more wagers for the one or more features of the electronic wagering game;

highlighting, via the potential bank layout pattern, one of the number of graphics;

requesting, via the potential bank layout pattern, user input at one of the plurality of wagering game machines to indicate that the one of the number of graphics corresponds to the wagering game machine, wherein the one of the number of graphics represents a physical position of the wagering game machine in relation to physical locations of others of the plurality of wagering game machines within the potential bank layout pattern according to the specific orientation;

receiving, via an input device associated with the wagering game machine, the user input, which indicates that the one of the plurality of wagering game machines corresponds to the one of the number of graphics that is highlighted within the potential bank layout pattern; and in response to the receiving, storing, in a memory device, a mapping of the physical position of the wagering game machine in relation to the physical locations of the others of the plurality of wagering game machines within the potential bank layout pattern.

2. The method of claim 1, wherein the specific orientation comprises one of a member of the group consisting of a straight line of wagering game machines, a circle of wagering game machines, a back-to-back row of wagering game machines, or a curved line of wagering game machines.

3. The method of claim 1, wherein the providing the potential bank layout pattern is in response to automatically determining network addresses for the plurality of wagering game machines associated with the bank of related wagering game machines, and wherein the gaming system lacks sufficient information to automatically ascertain which one of the network addresses corresponds to the one of the plurality of wagering game machines that corresponds to the one of the number of graphics.

4. The method of claim 1 further comprising:

determining a perspective of a technician relative to the bank of related wagering game machines; and highlighting, via the potential bank layout pattern, the one of the number of graphics based on the determined perspective of the technician.

5. The method of claim 4, wherein the determining the perspective of the technician comprises:

recording, via a camera, an image the bank of related wagering game machines relative to the technician; and determining, via digital optical recognition of the image, the perspective of the technician.

6. The method of claim 5, wherein the determining, via the digital optical recognition of the image, the perspective of the technician comprises:

determining, based on the digital optical recognition of the image, one or more of a position or orientation of one or more unique identifiers physically visible on at least one of the bank of related wagering game machines, and determining the perspective of the technician based at least in part on the determining the one or more of the position or orientation of the one or more unique identifiers.

7. The method of claim 1, wherein the potential bank layout pattern is one or more of an unpopulated or incomplete representation of the bank of related wagering game machines, and wherein the requesting, via the potential bank layout pattern, the user input at one of the plurality of wagering game machines is a request to specify one or more of populated or complete representation of the bank of related wagering game machines.

8. One or more non-transitory, machine-readable storage media having instructions stored thereon, which when executed by a set of one or more processors of a gaming system cause the gaming system to perform operations comprising:

providing, via an electronic gaming network, for presentation at a wagering game machine of a plurality of wagering game machines, a potential bank layout pattern for a bank of related wagering game machines, wherein the potential bank layout pattern presents, according to a configuration requirement, a number of graphics that represent a required number of wagering game machines laid out in a specific orientation relative to each other for play of one or more features of an electronic wagering game, and wherein the wagering game machine includes a value input device configured to receive physical money to increase a credit balance for placement of one or more wagers for the one or more features of the electronic wagering game;

highlighting, via the potential bank layout pattern, one of the number of graphics;

requesting, via the potential bank layout pattern, user input at one of the plurality of wagering game machines to indicate that the one of the number of graphics corresponds to the wagering game machine, wherein the one of the number of graphics represents a physical position of the wagering game machine in relation to physical locations of others of the plurality of wagering game machines within the potential bank layout pattern according to the specific orientation;

receiving, via an input device associated with the wagering game machine, the user input, which indicates that the one of the plurality of wagering game machines corresponds to the one of the number of graphics that is highlighted within the potential bank layout pattern; and in response to the receiving, storing, in a memory device, a mapping of the physical position of the wagering game machine in relation to the physical locations of the others of the plurality of wagering game machines within the potential bank layout pattern.

9. The one or more non-transitory, machine-readable storage media of claim 8, wherein the specific orientation comprises one of a member of the group consisting of a straight line of wagering game machines, a circle of wagering game machines, a back-to-back row of wagering game machines, or a curved line of wagering game machines.

10. The one or more non-transitory, machine-readable storage media of claim 8, wherein the providing the potential bank layout pattern is in response to automatically determining network addresses for the plurality of wagering game machines associated with the bank of related wagering game machines, and wherein the gaming system lacks sufficient information to automatically ascertain which one of the network addresses corresponds to the one of the plurality of wagering game machines that corresponds to the one of the number of graphics.

11. The one or more non-transitory, machine-readable storage media of claim 8, wherein the potential bank layout pattern is one or more of an unpopulated or incomplete representation of the bank of related wagering game machines, and wherein the requesting, via the potential bank layout pattern, the user input at one of the plurality of wagering game machines is a request to specify one or more of populated or complete representation of the bank of related wagering game machines.

12. The one or more non-transitory, machine-readable storage media of claim 8, said operations further comprising:

determining a perspective of a technician relative to the bank of related wagering game machines; and highlighting, via the potential bank layout pattern, the one of the number of graphics based on the determined perspective of the technician.

13. The one or more non-transitory, machine-readable storage media of claim 12, wherein the determining the perspective of the technician comprises:

recording, via a camera, an image the bank of related wagering game machines relative to the technician; and determining, via digital optical recognition of the image, the perspective of the technician.

14. The one or more non-transitory, machine-readable storage media of claim 13, wherein the determining, via the digital optical recognition of the image, the perspective of the technician comprises:

determining, based on the digital optical recognition of the image, one or more of a position or orientation of one or more unique identifiers physically visible on at least one of the bank of related wagering game machines, and determining the perspective of the technician based at least in part on the determining the one or more of the position or orientation of the one or more unique identifiers.

15. A gaming system comprising:

one or more electronic processors; and a memory storage device configured to store instructions, which when executed by at least one of the one or more electronic processors, cause the gaming system to perform operations to, provide, via an electronic gaming network, for presentation at a wagering game machine of a plurality of wagering game machines, a potential bank layout pattern for a bank of related wagering game machines, wherein the potential bank layout pattern presents, according to a configuration requirement, a number of graphics that represent a required number of wagering game machines laid out in a specific orientation relative to each other for play of one or more features of an electronic wagering game, and wherein the wagering game machine includes a value input device configured to receive physical money to increase a credit balance for placement of one or more wagers for the one or more features of the electronic wagering game, highlight, via the potential bank layout pattern, one of the number of graphics, request, via the potential bank layout pattern, user input at one of the plurality of wagering game machines to indicate that the one of the number of graphics corresponds to the wagering game machine, wherein the one of the number of graphics represents a physical position of the wagering game machine in relation to physical locations of others of the plurality of wagering game machines within the potential bank layout pattern according to the specific orientation, receive, via an input device associated with the wagering game machine, the user input, which indicates that the one of the plurality of wagering game machines corresponds to the one of the number of graphics that is highlighted within the potential bank layout pattern, and in response to the user input being received, electronically store a mapping of the physical position of the wagering game machine in relation to the physical locations of the others of the plurality of wagering game machines within the potential bank layout pattern.

16. The gaming system of claim 15, wherein the specific orientation comprises one of a member of the group consisting of a straight line of wagering game machines, a circle of wagering game machines, a back-to-back row of wagering game machines, or a curved line of wagering game machines.

17. The gaming system of claim 15, wherein the memory storage device is configured to store instructions, which when executed by at least one of the one or more electronic processors, cause the gaming system to provide the potential bank layout pattern in response to automatically determining network addresses for the plurality of wagering game machines associated with the bank of related wagering game machines, and wherein the gaming system lacks sufficient information to automatically ascertain which one of the network addresses corresponds to the one of the plurality of wagering game machines that corresponds to the one of the number of graphics.

18. The gaming system of claim 15, wherein the potential bank layout pattern is one or more of an unpopulated or incomplete representation of the bank of related wagering game machines, and wherein the memory storage device is configured to store instructions, which when executed by at least one of the one or more electronic processors, cause the gaming system to request to specify one or more of a populated or complete representation of the bank of related wagering game machines.

19. The gaming system of claim 18, wherein the memory storage device is configured to store instructions, which when executed by at least one of the one or more electronic processors, cause the gaming system to:

determine a perspective of a technician relative to the bank of related wagering game machines; and highlight, via the potential bank layout pattern, the one of the number of graphics based on the determined perspective of the technician.

20. The gaming system of claim 19, wherein the memory storage device is configured to store instructions, which when executed by at least one of the one or more electronic processors, cause the gaming system to:

record, via a camera, an image the bank of related wagering game machines relative to the technician; and determine, via digital optical recognition of the image, the perspective of the technician.

21. The gaming system of claim 20, wherein the memory storage device is configured to store instructions, which when executed by at least one of the one or more electronic processors, cause the gaming system to:

determine, based on the digital optical recognition of the image, one or more of a position or orientation of one or more unique identifiers physically visible on at least one of the bank of related wagering game machines, and determine the perspective of the technician based at least in part on determination of the one or more of the position or orientation of the one or more unique identifiers.

* * * * *